US006581411B2

(12) United States Patent
Massimo et al.

(10) Patent No.: US 6,581,411 B2
(45) Date of Patent: Jun. 24, 2003

(54) PLANT FOR PRODUCING HIGH PRESSURE OXYGEN BY AIR DISTILLATION

(75) Inventors: Giovanni Massimo, Brussels (BE); Alain Guillard, Paris (FR)

(73) Assignee: L'Air Liquide - Societe Anonyme A'Directoire et Conseil de Surveillance pour l'Etude et l'Explotation des Procedes Georges Claude, Paris (FR)

( * ) Notice: Subject to any disclaimer, the term of this patent is extended or adjusted under 35 U.S.C. 154(b) by 0 days.

(21) Appl. No.: 10/217,922

(22) Filed: Aug. 13, 2002

(65) Prior Publication Data

US 2003/0033832 A1 Feb. 20, 2003

(30) Foreign Application Priority Data

Aug. 14, 2001 (FR) ..... 01 10817

(51) Int. Cl.[7] ..... F25J 3/00
(52) U.S. Cl. ..... 62/643; 62/648; 62/902
(58) Field of Search ..... 62/643, 649, 648, 62/654, 902; 60/772

(56) References Cited

U.S. PATENT DOCUMENTS 4,060,339 A * 11/1977 Raff et al. ..... 417/2
5,538,534 A * 7/1996 Guillard et al. ..... 75/466
5,865,023 A * 2/1999 Sorensen et al. ..... 60/775
5,896,755 A * 4/1999 Wong et al. ..... 62/643
6,051,048 A * 4/2000 Keenan ..... 75/492
6,117,916 A * 9/2000 Allam et al. ..... 518/702
6,128,921 A * 10/2000 Guillard et al. ..... 62/643
6,141,950 A * 11/2000 Smith et al. ..... 60/783
2002/0020165 A1 * 2/2002 Fuentes et al. ..... 60/39.181
2002/0116945 A1 * 8/2002 Buckland ..... 62/645

FOREIGN PATENT DOCUMENTS

EP 0971188 4/1999
FR 2774753 6/1998

OTHER PUBLICATIONS

International PCT Search Report.
Mason, Kenneth (1997) Publication—"Process and Facility with Particularly High Availability", XP000726402.

* cited by examiner

*Primary Examiner*—William C. Doerrler
(74) *Attorney, Agent, or Firm*—Linda K. Russell

(57) ABSTRACT

This plant comprises N (N>1) air distillation units (1) in parallel, each one of which comprises a main air compressor (3) driven by a steam turbine (4); an air distillation apparatus (8) producing liquid oxygen and/or liquid nitrogen; at least one pump (9) for pumping liquid oxygen and/or liquid nitrogen to a high production pressure; and a cycle compressor (10) adapted to compress part of a cycle fluid.

Each cycle compressor (10) is driven by an electric motor (11), and an (N+1)th steam turbine (12) drives an alternator (13) supplying the electric motors (11) with electric current.

Application to supplying units (2) for producing synthetic hydrocarbons with high-pressure oxygen.

13 Claims, 1 Drawing Sheet

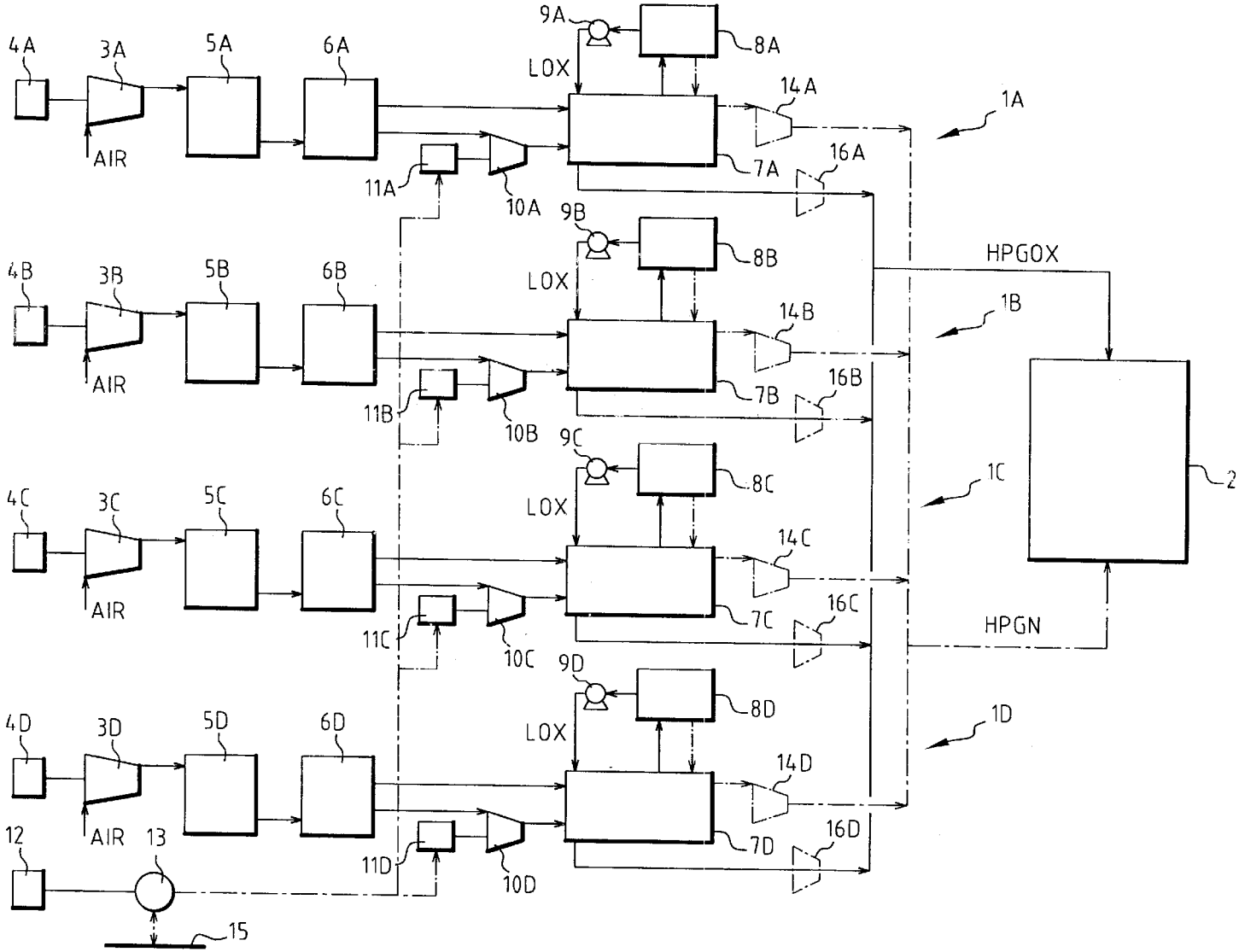
2
HPGOX
HPGN
1A
1B
1C
1D
16A
16B
16C
16D
14A
14B
14C
14D
8A
8B
8C
8D
7A
7B
7C
7D
9A
9B
9C
9D
LOX
10A
10B
10C
10D
11A
11B
11C
11D
6A
6B
6C
6D
5A
5B
5C
5D
3A
3B
3C
3D
AIR
4A
4B
4C
4D
12
13
15

PLANT FOR PRODUCING HIGH PRESSURE OXYGEN BY AIR DISTILLATION

The present invention to a plant for producing high-pressure oxygen by air distillation.

The invention is applicable to the production of very large quantities of high-pressure oxygen, especially for supplying units producing synthetic hydrocarbons.

In this case, the pressures involved are absolute pressures.

Industrial units for producing synthetic hydrocarbons, called "GTL" (Gas-To-Liquid) units, commonly have a production capacity close to 50 000 barrels per day, which corresponds to an oxygen consumption of about 12 000 tonnes per day.

In order to produce such quantities of oxygen, it is necessary to provide several air distillation units in parallel, typically three or four units. Furthermore, in order to bring the oxygen to the high pressure needed for operation of the GTL unit, it is advantageous to bring the liquid oxygen produced by distillation to this high pressure by pumping, and to vaporize the liquid by heat exchange with a cycle fluid compressed to a high oxygen vaporization pressure, it being possible for this cycle fluid to be supercharged air or nitrogen. Thus, the use of gaseous oxygen compressors, always awkward, is avoided.

Consequently, each air distillation unit generally comprises two compression apparatus: on the one hand, a main air compressor, which brings all the treated atmospheric air to a medium distillation pressure (typically 5 to 8 bar for distillation in an apparatus comprising at least two distillation columns), and on the other hand, a cycle compressor, especially an air supercharger, which brings part of the compressed air stream to a high pressure enabling the pumped liquid oxygen to vaporize.

In the usual art, each main compressor is driven by a dedicated steam turbine, which may be a backpressure turbine, blowing off at a pressure greater than atmospheric pressure, or a condensation turbine, blowing off at a pressure less than atmospheric pressure and combined with a water condenser, cooled by water or by ambient air, and with a pump recycling the water to the steam production boiler. Similarly, each cycle compressor is driven by a dedicated steam turbine.

The result of this arrangement is a very high cost for the air compression means, especially when using condensation turbines, which are complex and expensive machines.

The aim of the invention is to reduce the investment associated with plants of the aforementioned type.

To this end, the subject of the invention is a plant for producing high-pressure oxygen by air distillation, characterized in that it comprises N (N>1) air distillation units in parallel, each one of which comprises: a main air compressor adapted to compress the atmospheric air to be distilled; a steam turbine for driving the main compressor; means for precooling air; means for purifying air of water and of $CO_2$; a main heat exchange line adapted to cool the compressed air down to a temperature allowing it to be distilled; an air distillation apparatus producing liquid oxygen and/or liquid nitrogen; at least one pump for pumping the liquid oxygen and/or the nitrogen to at least one high production pressure; and a cycle compressor adapted to compress a cycle fluid to a high pressure allowing the pumped liquid nitrogen and/or liquid oxygen to vaporize, characterized in that each cycle compressor is driven by an electric motor, and in that the plant comprises an (N+1)th steam turbine which drives an alternator, the latter supplying the electric motors with electric current.

The plant according to the invention may comprise one or more of the following characteristics:

- the plant comprises N electric motors, each driving one of the cycle compressors;
- the (N+1)th steam turbine is similar to each of the N other steam turbines;
- the cycle compressor is an air supercharger adapted to supercharge part of the compressed air by the main air compressor;
- each air distillation apparatus also produces gaseous nitrogen and each air distillation unit further comprises a gaseous nitrogen compressor adapted to compress the gaseous nitrogen to a high production pressure;
- the electric current supply for the motors is supplemented by makeup coming from the grid;
- the alternator produces an excess of electrical energy, which is exported to the grid; and
- the plant comprises at least one unit for producing synthetic hydrocarbons, which unit is supplied with oxygen, and possibly with nitrogen, at their high production pressure.

One exemplary embodiment of the invention will now be described with regard to the appended drawing, the single FIGURE of which shows very schematically a plant according to the invention.

The plant shown in the drawings comprises four air distillation units, 1A to 1D, in parallel which feed high-pressure oxygen to one or more GTL unit(s) 2. The high production pressure of the units 1A to 1D is typically between 30 and 65 bar, and each of these units typically produces around 3 000 tonnes per day of oxygen.

Each unit 1 (that is to say 1A to 1D) comprises:

- a main air compressor 3 driven by a condensation steam turbine 4 which is dedicated thereto;
- an air precooler 5 precooling with air or with water;
- an apparatus 6 purifying air of water and of $CO_2$ by adsorption;
- a main heat exchange line 7;
- an air distillation apparatus 8 comprising at least one air distillation column;
- at least one liquid oxygen pump 9; and
- an air supercharger 10 driven by an electric motor 11 which is dedicated thereto.

The plant further comprises a fifth condensation steam turbine 12, which may advantageously be similar to the turbines 4A to 4D, that is to say of the same type and substantially of the same power, and which drives a single alternator 13. The latter supplies the four motors 11 with electric current.

In operation, for each unit 1A to 1D, the atmospheric air, entirely compressed to the medium distillation pressure at 3, is precooled close to the ambient temperature at 5 and purified at 6. About 35% of the air stream is supercharged at 10. The two air flows are cooled in the exchange line 7, then sent at medium pressure to the distillation apparatus 8.

The products coming from the apparatus 8 are reheated counter-currentwise to the air flows in the exchange line 7. In particular, the liquid oxygen produced by the low-pressure column (LOX) is pumped to the high production pressure at 9, and vaporized by condensation of the supercharged air, then reheated close to ambient temperature, in order to supply the desired high-pressure gaseous oxygen flow (HPGOX).

Each compressor 3 consumes a power of about 50 to 60 MW, while each supercharger 10 consumes a power of about 15 MW. Thus, the steam turbine 12 may be similar to each of the turbines 4A to 4D, also providing a power of about 60 MW. A significant saving may thus be obtained on the stock of spare parts for the entire plant.

As indicated in dot-dash lines, each distillation unit may optionally further provide high-pressure gaseous nitrogen (HPGN) to the unit 2. This nitrogen may be compressed in gaseous form by a nitrogen compressor 14, as shown. As a variant, the nitrogen may be pumped to high pressure in liquid form and vaporized in the exchange line 7 by condensation of an additional stream of supercharged air.

As will be understood, in some cases, the alternator 13 may produce insufficient electric power to drive the motors 11, in which case electric power is made up by the grid 15. Otherwise, the alternator may produce excess electric power; this is then exported to the grid 15.

Moreover, the invention also applies to methods in which each compressor 4 compresses the air to a pressure other than the distillation pressure.

What is claimed is:

1. A plant for producing high-pressure oxygen by air distillation, aracterized in that it comprises N (N>1) air distillation units (1) in parallel, each one of which comprises: a main air compressor (3) adapted to compress the atmospheric air to be distilled; a steam turbine (4) for driving the main compressor; means (5) for precooling air; means (6) for purifying air of water and of $CO_2$; a main heat exchange line (7) adapted to cool the compressed air down to a temperature allowing it to be distilled; an air distillation apparatus (8) producing liquid oxygen and/or liquid nitrogen; at least one pump (9) for pumping the liquid oxygen and/or the nitrogen to at least one high production pressure; and a cycle compressor (10) adapted to compress a cycle fluid to a high pressure allowing the pumped liquid nitrogen and/or liquid oxygen to vaporize, wherein each cycle compressor (10) is driven by an electric motor (11), and the plant comprises an (N+1)th steam turbine (12) which drives an alternator (13), wherein the alternator (13) supplies the electric motors (11) with electric current.

2. The plant as claimed in claim 1. wherein the plant comprises N electric motors (11), each driving one of the cycle compressors (10).

3. The plant as claimed in claim 2, wherein the (N+1)th steam turbine (12) is equivalent to each of the N other steam turbines (4).

4. The plant as claimed in claim 2, wherein the cycle compressor (10) is an air supercharger adapted to supercharge part of the compressed air by the main air compressor (3).

5. The plant as claimed in claim 3, wherein the cycle compressor (10) is an air supercharger adapted to supercharge part of the compressed air by the main air compressor (3).

6. The plant as claimed in claim 3, wherein each air distillation apparatus (8) also produces gaseous nitrogen, and in that each air distillation unit (1) further comprises a gaseous nitrogen compressor (14) adapted to compress the gaseous nitrogen to a high production pressure.

7. The plant as claimed in claim 4, wherein each air distillation apparatus (8) also produces gaseous nitrogen, and in that each air distillation unit (1) further comprises a gaseous nitrogen compressor (14) adapted to compress the gaseous nitrogen to a high production pressure.

8. The plant as claimed in claim 5, wherein each air distillation apparatus (8) also produces gaseous nitrogen, and in that each air distillation unit (1) further comprises a gaseous nitrogen compressor (14) adapted to compress the gaseous nitrogen to a high production pressure.

9. The plant as claimed in claim 1, wherein the electric current supply for the motors (11) is supplemented by makeup coming from the grid.

10. The plant as claimed in claim 1, wherein the alternator (13) produces an excess of electrical energy, which is exported to the grid.

11. The plant as claimed in claim 1, wherein the plant comprises at least one unit (2) for producing synthetic hydrocarbons, which unit is supplied with oxygen at its high production pressure.

12. The plant as claimed in claim 11, wherein the plant additionally comprises nitrogen, supplied to the unit at its high production pressure.

13. A plant for producing high-pressure oxygen by air distillation, wherein the plant includes at least one unit (2) for producing synthetic hydrocarbons, characterized in that it comprises N (N>1) air distillation units (1) in parallel, each one of which comprises: a main air compressor (3) adapted to compress the atmospheric air to be distilled; a steam turbine (4) for driving the main compressor; means (5) for precooling air; means (6) for purifying air of water and of $CO_2$; a main heat exchange line (7) adapted to cool the compressed air down to a temperature allowing it to be distilled; an air distillation apparatus (8) producing liquid oxygen and/or liquid nitrogen; at least one pump (9) for pumping the liquid oxygen and/or the nitrogen to at least one high production pressure; and a cycle compressor (10) adapted to compress a cycle fluid to a high pressure allowing the pumped liquid nitrogen and/or liquid oxygen to vaporize, wherein each cycle compressor (10) is driven by an electric motor (11), and the plant comprises an (N+1)th steam turbine (12) which drives an alternator (13), wherein the alternator (13) supplies the electric motors (11) with electric current.

* * * * *